United States Patent [19]

Nogueira

[11] Patent Number: 4,622,744

[45] Date of Patent: Nov. 18, 1986

[54] FOLDING KNIFE WITH LOCKING DEVICE

[76] Inventor: Lauro A. Nogueira, Fazenda Chapeu, Municipio De Campos Altos, Minas Gerais, Brazil

[21] Appl. No.: 672,874

[22] Filed: Nov. 19, 1984

[30] Foreign Application Priority Data

May 25, 1983 [BR] Brazil ..... 6300691

[51] Int. Cl.[4] ..... B26B 1/04

[52] U.S. Cl. ..... 30/155

[58] Field of Search ..... 30/155, 156, 157, 161, 30/296 A

[56] References Cited

U.S. PATENT DOCUMENTS

| | | | |
|---|---|---|---|
| 971,057 | 9/1910 | Luce | 30/155 X |
| 1,124,651 | 1/1915 | Peterson | 30/155 |
| 1,561,993 | 11/1925 | Nielsen | 30/161 X |
| 2,777,195 | 1/1957 | Dalianis | 30/155 |
| 4,083,110 | 4/1978 | Goldin | 30/155 |

*Primary Examiner*—Jimmy C. Peters

*Attorney, Agent, or Firm*—Young & Thompson

[57] ABSTRACT

A folding knife has a U-shaped body between the ends of the legs of which a blade is mounted for pivotal movement about an axis, beween open and closed positions. One leg is shorter than the other leg, and that one leg has a laterally extending protuberant portion having a hole centrally therethrough and bevellings on opposite sides of the hole. On that same side of the blade, the blade has two projections spaced equal distances from and on opposite sides of the pivotal axis of the blade, that distance being the same as the distance between the hole and the pivotal axis. As a result, the projections on the blade slide up the bevellings with a cam action upon approaching the open or closed position and snap into the hole. The sides of the projections are inclined, so that there is a cam action by which they can snap out of the hole when moving from one position toward the other position.

6 Claims, 4 Drawing Figures

FOLDING KNIFE WITH LOCKING DEVICE

The present invention relates to a folding knife with means for locking the blade selectively in open or closed position, thereby providing safety for the user when using or carrying the knife, and preventing spontaneous opening or closing of the knife.

Figure 1:
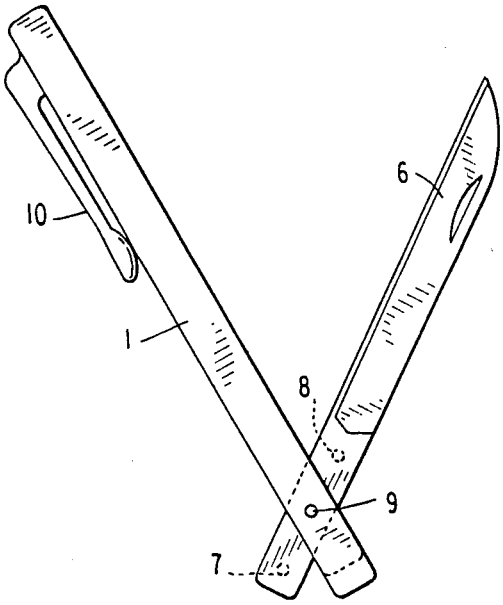
FIG. 1 is a side view of one side of the knife halfway open.
Figure 2:
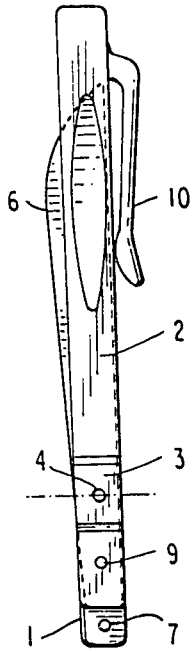
FIG. 2 is a side view of the side of the knife opposite that shown in FIG. 1, in closed position.
Figure 4:
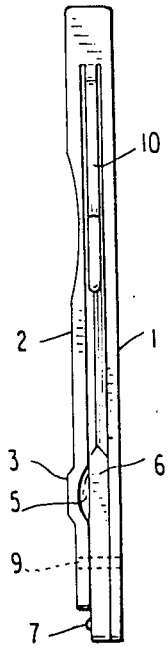
FIG. 4 is an edgewise view taken from the right of FIG. 2.
Figure 3:
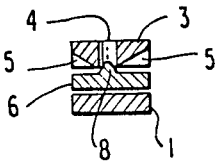
FIG. 3 is an enlarged cross-sectional view on the broken line of FIG. 2.

Referring now to the drawing in greater detail, the knife of the present invention has a U-shaped body having one leg 1 longer than the other leg 2. Leg 2 has a protuberant portion 3 having a central hole 4, and, on its inner face, a double bevelling 5 so that ramps are provided on either side of hole 4.

Between legs 1 and 2 is housed the knife blade 6, whose sharp edge is of course disposed between legs 1 and 2 in the closed position of the knife. Blade 6 has spaced projections 7 and 8 thereon, and is pivotally mounted on and between legs 1 and 2 for swinging movement between open and closed positions, about an axle 9 that is midway between projections 7 and 8. The distance between axle 9 and either projection 7 or 8, is equal to the distance between axle 9 and hole 4.

A clip 10 extends from the junction between legs 1 and 2, lengthwise along the U-shaped body, on the side thereof opposite that from which blade 6 exits upon opening of the knife. Clip 10 facilitates carrying the knife in the pocket.

In use, let us suppose that the knife is in the FIG. 1 position, that is, half open. To close the knife, the blade 6 is swung counterclockwise from the FIG. 1 position to closed position, whereupon the projection 8 encounters one of the bevellings 5 and is cammed along that surface until it snaps into hole 4. The blade of the knife is of course made of metal and the U-shaped body can be metal or plastic or other rigid but resilient material; and so the inherent resiliency of the parts permits the necessary relative lateral movement between leg 2 and blade 6, to permit this camming and snap action to take place.

To open the knife, the blade is engaged with the fingernail in the usual manner and the blade is pulled in the clockwise direction as seen in FIG. 1, whereupon the projection 8, whose side walls are inclined, slides against the margins of hole 4 with a camming action to reverse the process previously described, until projection 8 snaps out of hole 4 and the knife can be freely swung to open position.

As the knife approaches open position, it is now the projection 7 that engages the other bevelling 5 on the opposite side of hole 4, and slides along that bevelling until projection 7 snaps into hole 4, whereupon the blade is securely but releaseably held in the open position, that is, in alignment with the elongated U-shaped body. To close the knife, pressure is applied between the body and the blade to cause the blade to swing counterclockwise as seen in FIG. 1, whereupon projection 7, whose side walls are inclined as those of projection 8, cams against the margins of hole 4 and snaps out of hole 4, thereby freeing the blade to move toward closed position.

What is claimed is:

1. A folding knife having a U-shaped body comprised by two straight flat legs each lying in one of two parallel planes, a straight flat blade lying in a plane between and parallel to said two parallel planes, said blade being mounted for pivotal movement between the legs about an axis adjacent the ends of the legs, one of the legs having a hole therethrough, and two projections on the same side of the blade as the hole, the two projections being spaced equal distances on opposite sides of said axis and being spaced from said axis the same distance as said hole, the projections being adapted to snap into and out of said hole thereby to hold the blade releasably in open or closed position.

2. A knife as claimed in claim 1, there being an outwardly extending protuberant portion on said one leg about said hole, and bevelling on said one leg on the inner side of said protuberant portion on opposite sides of said hole, said bevelling providing inclined surfaces along which said projections slide with a cam action when approaching and leaving said hole.

3. A knife as claimed in claim 2, the side walls of said projections being inclined.

4. A knife as claimed in claim 1, the side walls of said projections being inclined.

5. A knife as claimed in claim 1, said one leg being shorter than the other leg, one of said projections being spaced beyond the end of said one leg in the closed position of the knife.

6. A knife as claimed in claim 1, and a clip to retain the knife in a clothing pocket, the clip being secured to the base of the U-shaped body and extending from said base partway along the length of the legs in a direction toward said axis, the clip being disposed between said two parallel planes but outside the contour of said legs when viewed in a direction perpendicular to said planes, the blade having a single sharpened edge that is adjacent the clip when the knife is in said closed position.

* * * * *